US005433526A

United States Patent [19]

Wild

[11] Patent Number: 5,433,526

[45] Date of Patent: Jul. 18, 1995

[54] FLEXIBLE BAG

[75] Inventor: Ranier Wild, Heidelberg, Germany

[73] Assignee: Indag Gesellschaft fur Industriebedarf mBH, Heidelberg-Eppelheim, Germany

[21] Appl. No.: 730,979

[22] PCT Filed: Jan. 12, 1990

[86] PCT No.: PCT/EP90/00066

§ 371 Date: Jul. 8, 1991

§ 102(e) Date: Jul. 8, 1991

[87] PCT Pub. No.: WO90/08070

PCT Pub. Date: Jul. 26, 1990

[30] Foreign Application Priority Data

Jan. 13, 1989 [DE] Germany ..... 8900366 U

[51] Int. Cl.[6] ..... B65D 30/10

[52] U.S. Cl. ..... 383/35; 383/104; 383/904

[58] Field of Search ..... 383/35, 904, 104; 141/313, 314

[56] References Cited

U.S. PATENT DOCUMENTS 3,113,715 12/1963 Pangrac .
4,078,717 3/1978 Stearley .
4,261,253 4/1981 Smith, II .
4,848,931 7/1989 Kamada et al. ..... 383/104

FOREIGN PATENT DOCUMENTS 0216327 4/1987 European Pat. Off. .
8807593 10/1988 Germany .

*Primary Examiner*—Stephen P. Garbe
*Attorney, Agent, or Firm*—Nixon & Vanderhye

[57] ABSTRACT

The invention relates to a flexible bag made of a heat-sealable or weldable plastic sheet material and adapted to contain liquid and/or pasty products, the bag comprising two sidewall-forming flat parts sealingly connected to one another along their longitudinal margins and along their lower transverse margin, and forming a dispensing opening adjacent their upper ends.

In order to facilitate opening the bag, the invention proposes that two oppositely disposed portions of the sidewalls adjacent the dispensing opening are each provided with at least one outwards projecting bead, the beads of the two sidewalls being disposed opposite one another at congruent positions and terminating at the edge of the dispensing opening.

19 Claims, 1 Drawing Sheet

FLEXIBLE BAG

BACKGROUND OF THE INVENTION

1. Field of the Invention

The invention relates to a flexible bag of a heat-sealable or heat-weldable plastic sheet material and adapted to receive liquid and/or pasty media, comprising two sidewall-forming flat elements sealingly connected to each other along their longitudinal edges and their lower transverse edge and forming a dispensing opening at their upper end.

2. Discussion of Prior Art

Such bags made of plastic sheet material are known in particular for use as disposable beverage packages e.g. from DE-U-88 07 593.1. Such packages usually terminate in a pointed end and have a filling volume of 0.2 litres. The sheet material employed for such beverage packages comprises a thick aluminum sheet layer serving among other purposes to stabilize the package. Such flexible bags are usually designed as stand-up bags. The bottom side is formed with a support bottom permitting the bag to be placed on a support after it has been opened without the risk of the bag's contents spilling from the dispensing opening or the bag toppling over. In beverage packages of this type the dispensing opening may for instance be determined by a pierceable, weakened portion capable of being pierced by a drinking straw terminating in a pointed end.

Aside from beverages, flexible bags are also used for filling them with liquid or pasty media, e.g. liquid detergents. Flexible bags of this type are mainly used as refill packages.

A basic advantage of the flexible bags can be seen in the fact that they can be folded extremely flat in their empty state so as to require very little space.

The filling of such flexible bags with liquid or pasty media is carried out in an automatic operation. For this purpose, the bag is placed upright with its dispensing opening pointing upwardly so as to permit a filling spout to be inserted thereinto. After the bag has been filled, the dispensing opening is closed by welding or sealing. During the fully automatic filling of the flexible bags at a high speed it has been found difficult to open the dispensing opening or dispensing spout in such fashion that the filling spout can be inserted, since the sheet material walls often tend to stick together.

A flexible plastic bag is known from US-A-40-78 717 which was produced from a sheet material tube. Grip aids are impressed in the sidwalls of the folded tube to make a manual unfolding of the bag possible. However, these grip aids do not allow the putting on of suction means.

A bag consisting mainly of cardboard is known from US-A-42 61 253. The impressing lines in the sidewalls of the bag and at a folding edge serve as joints, about which an unfolding of the sidewalls of the bags in prismatic form becomes possible upon the exertion of pressure on the opposite side edges.

SUMMARY OF THE INVENTION

It is the object of the invention to provide a flexible bag, whose dispensing opening or dispensing spout can be easily opened for the filling operation and which is in particular suited for an automatic filling operation.

This object is attained according to the invention by the fact that at least one embossed area extends in each case in the area of the dispensing opening in two opposite parts of the sidewall, which is outwardly directed from the inner sides, the embossed area of the two sidewalls being opposite to each other in coinciding positions and terminating at the edge of the dispensing opening.

An opening is formed by the embossed areas which are opposite to each other and are outwardly directed in the area of the dispensing opening, which is also present in the folded flexible bag. This opening offers the great advantage that it permits air to enter the flexible bag as soon as the unfolding of the bag is initiated for instance by means of suction devices disposed at lateral positions adjacent the dispensing opening and operable to pull the two side-walls apart. Since the opening defined by the embossed areas permits air to readily enter the bag at this time, the suction devices are capable of readily opening the dispensing opening, because the sidewalls will no longer tend to adhere to one another adjacent the dispensing opening. It is also conceivable to insert a filling spout, which may be adequately thin and/or provided with a pointed end, into the opening defined by the oppositely located embossed areas.

The formation of an embossed area in each of the two opposite sidewall portions results in the advantage that a relatively shallow depth of the embossed areas is sufficient for obtaining an opening of a suitable size by the cooperation of the two embossed areas. An opening of suitable size could also be obtained by the formation of an embossed area in only one of the sidewalls, although this embossed area would then have to be of a greater depth, which might lead to problems when the dispensing opening is to be closed by welding. If need be the extension of the flexible sheet bag forming the dispensing opening may be of a suitably extended length, with the embossed areas formed in the end portion of this extension. A flexible sheet bag of this construction may then be closed by a welded seam below the embossed areas, so that the extended portion formed with the embossed areas may be subsequently cut off.

The embossed areas preferably extend parallel to the sealed longitudinal margins of the sidewalls, so that a filling spout can be vertically introduced into the opening defined by the embossed areas in the upright position of the bag. A length of the embossed areas of 10 mm to 50 mm has been found sufficient, the preferred length being between 10 and 30 mm. Each embossed area is preferably formed in the shape of a channel, the width of each embossed area being preferably 5 mm to 10 mm, at least when there is only one embossed area in each sidewall.

In an advantageous alternative embodiment each sidewall is preferably formed with three embossed areas disposed mirror-imagewise at congruent positions, so that the space defined between the sidewalls at the location of the mutually facing embossed areas forms a rhombus-shaped opening. In this case all of the embossed areas preferably extend substantially parallel to one another, with a width of each bead of 0.5 to 1 mm being sufficient. In a dispensing opening of this configuration the open side of the intermediate embossed area faces towards the interior, i.e. towards the opposite sidewall, while the open sides of the two outer embossed areas to the left and to the right of the intermediate embossed area form respective channels in the outer face of the bag. If the bag is formed with a plurality of individual embossed areas, the spacing therebetween should be no more than 5 to 10 mm.

In still another advantageous embodiment the embossed areas extending in the longitudinal direction, i.e. in the direction of the longitudinal weld seams, are suitably shaped to define a V-shaped channel, i.e. the embossed areas diverge towards the end of the bag and/or terminate in a pointed end towards the lower portion of the bag, a length of the embossed areas of 10 to 50 mm being also sufficient in this case.

For obtaining an improved stability of a flexible sheet bag of the type described, the bag may be designed as a stand-up bag by the incorporation of a foldable bottom portion between the lower transverse margins of the sidewalls so as to be capable of lying flat between the sidewalls. A stand-up bag of this construction offers the advantage that its stability increases in the course of its being filled, enabling it to stand upright on its bottom portion without any external aid. The embossed areas may be formed in the pre-cut sheet components by means of a heated stamping die prior to the sidewalls being welded or sealed to one another. The flexible sheet bag is preferably made of a twin-layer heat-sealable compound sheet material.

Excellent properties are obtained when using a sheet material composed of a polyethylene sheet directed towards the interior and a polyester sheet forming an outer skin. The employ of a polyethylene sheet in the form of a co-extrusion sheet—i.e. a multi-layered sheet—offers the advantage that the sheet material forming the inner wall of the bag can be adapted to the intended employ of the bag and the requirements for such use. The side of the sheet to be sealed may thus be devised so as to be particularly readily sealable and die-shapable; by selecting a suitable composition of such a co-extrusion sheet material, it is also possible to obtain an improved stiffness or rigidity of the sheet. The thickness of the outwards facing polyester sheet is at least 10 μm, preferably 17 μm, whereas the inwards facing polyethylene or co-extrusion sheet should have a thickness of 80 μm to 200 μm, preferably of 100 μm to 150 μm.

In order to impart the greatest possible stability to the flexible bag in its upright standing position, the bag may advantageously assume a substantially cylindrical shape in its filled state. For obtaining this shape the two sidewalls are cut to a rectangular shape and sealed to one another along their longitudinal margins. The bottom portion is in this case cut to a substantially circular shape and sealed to the sidewalls of the bag in its collapsed state along a semicircular sealing seam. At the upper end the sidewalls of the filled cylindrical flexible sheet bag define a conically convergent shape, so that the filled bag terminates in a frustoconical portion formed with a dispensing opening.

As an alternative to the construction of the flexible sheet bag composed of two sidewall cuttings welded or sealed to one another along their longitudinal margins, a flexible sheet bag may also be formed of a single sheet blank, in which case one longitudinal edge of the bag is formed by a corresponding crease of the sheet blank.

BRIEF DESCRIPTION OF THE DRAWINGS

An embodiment of the invention shall now be described in detail by way of example with reference to the accompanying drawings, wherein.

DETAILED DISCUSSION OF PREFERRED EMBODIMENTS

Figure 1:
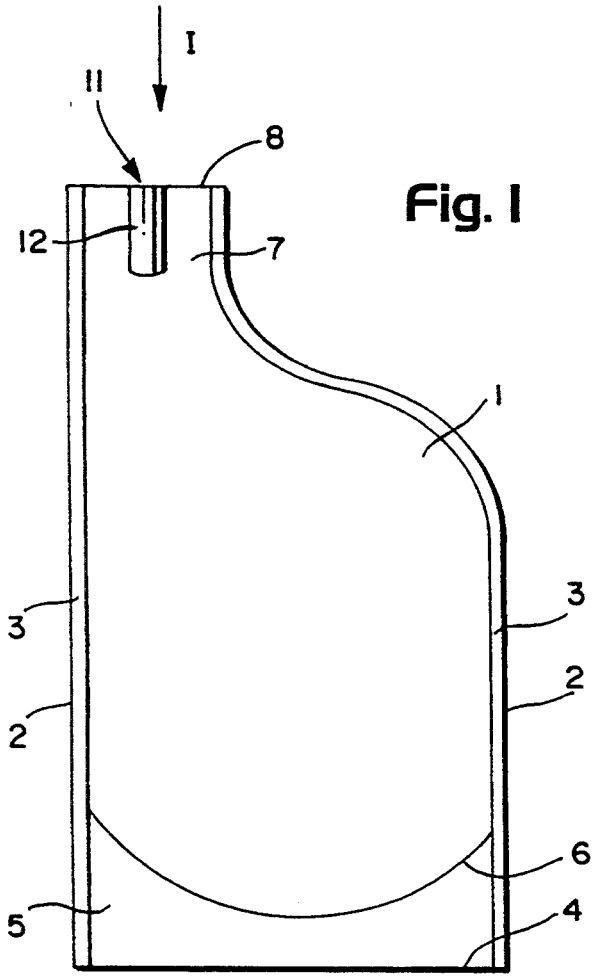
FIG. 1 shows a sideview or top plan view of a flexible sheet bag in its empty and folded or collapsed state.
Figure 2:
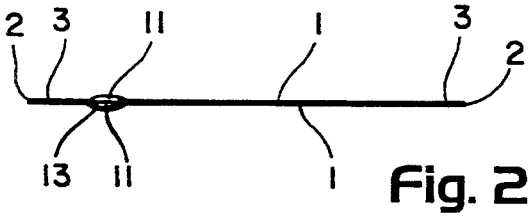
FIG. 2 shows an end view of the bag of FIG. 1 in the direction of the arrow I in this figure.

As particularly shown in FIG. 1 in combination with FIG. 2, a flexible sheet bag comprises two sidewalls 1 heat-sealed to one another along their vertically extending longitudinal margins 2 by the formation of respective sealing or weld seams 3. Incorporated between the lower transverse margins 4 of sidewalls 1 is a lower bottom portion 5 acting as a standing support bottom and formed of a circular or elliptical sheet cutting as clearly apparent in FIG. 1 from the shape of the bottom sealing seam 6. Bottom portion 5 and sidewalls 1 are surface-welded or sealed to each other over the entire area between lower transverse margin 4 and bottom sealing seam 6, so that a reinforced bag wall is obtained in this lower area by a twin-layer plastic sheet construction. The sidewalls of the bag are made of substantially rectangular sheet cuttings, resulting in a substantially cylindrical sidewall configuration in the filled state of the bag. The upper end portion of the bag is formed with a pouring spout 7 having a dispensing opening 8, to which purpose one of the longitudinal margins 2 of each cutting is shaped to extend towards the opposite longitudinal margin 2.

Although not shown in the drawings, at least the center portion of bottom 5 sags downwards in the filled state of the bag so as to come into contact with a bag-supporting surface to thereby impart a high stability to the bag in its upright standing position.

Figure 3:
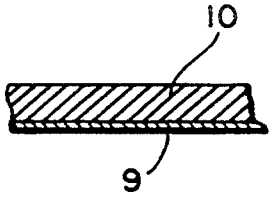
FIG. 3 shows a sectional view of a plastic sheet material used for making the flexible bag.

All cuttings of which the flexible bag is composed consist of a twin-layered plastic sheet material as depicted in section in FIG. 3. The outwards facing sheet 9 forming the outer skin is a polyester sheet having a thickness of 12 μm, whereas the inwards facing sheet 10 acting as the inner skin is a polyethylene sheet, specifically a co-extrusion sheet. A co-extrusion sheet of this kind is composed of several layers and permits its layered construction to be suitably varied during the extrusion process for adaptation to any specific requirements. Sheet 10 has a thickness of 150 μm, the indicated sheet thicknesses applying to a bag having a capacity of 1 to 1.5 litres, or at the most 2 litres.

As shown in FIGS. 1 and 2, respective portions of sidewalls 1 forming pouring spout 7 are each provided with a embossed area in the shape of a channel formed therein by means of a stamping die, the bottom of each such channel being directed outwards as shown in FIG. 2. These embossed areas 11 or channels 12 are located mirror-imagewise at congruent positions of the rear and front sidewalls 1, respectively, so that an opening 13 is defined therebetween. This opening 13 permits a filling spout to be readily inserted for the as the case may be automatic filling operation, so that the pouring spout 7 as a whole or at least the dispensing opening 8 between weld seams 3 is fully opened as the filling spout is inserted further into opening 13.

Figure 6:
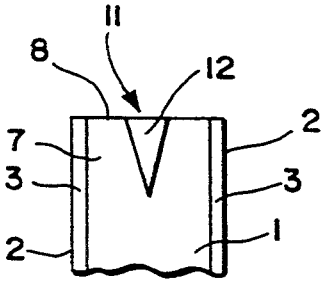
FIG. 6 shows another modification of a dispensing opening for a bag of the type shown in FIG. 1.

FIG. 6 illustrates an embodiment of a channel 12 corresponding to that shown in FIGS. 1 and 2 but converging in a V-shaped configuration towards its downwards pointing end. A V-shaped channel 12 or bead 11 of this kind has the advantage that its merges into the plane of the sidewall 1 in the collapsed or folded state of the bag. The channels 12 or embossed areas 11 as shown in the figures may be sealed or welded at any location in unison with the dispensing opening 8 as a whole to thereby close the bag after it has been filled. It is also possible, however, to extend the length of pouring spout 7 so as to permit it to be closed by sealing or welding at a location below the embossed areas whereupon the portion including the channels or beads may be cut off above the weld seam. The width of channels 12 in FIGS. 1 and 6 is about 10 mm, while the depth of each channel or embossed area 11 relative to the plane of the sidewall amounts to about 2 mm.

Figure 4:
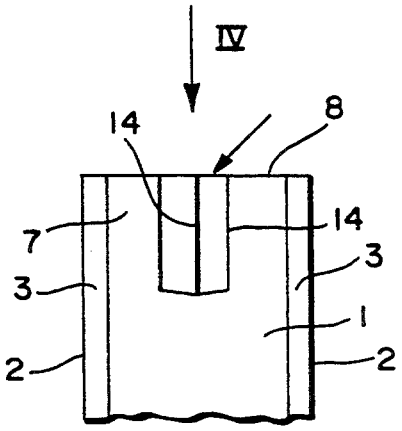
FIG. 4 shows an enlarged view of a dispensing opening or outlet spout of a modified embodiment of a flexible sheet bag.
Figure 5:
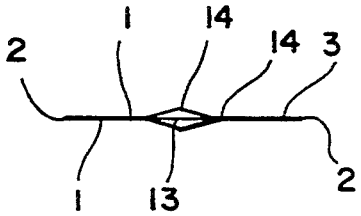
FIG. 5 shows an end view of the dispensing opening of FIG. 4 in the direction of the arrow IV in this figurer.

In FIGS. 4 and 5 each sidewall 1 is formed with a channel 12 formed by three separate embossed areas 14. The bottom of the intermediate one of the three embossed areas 14 is directed outwards, while the two outer embossed areas 14 have their bottoms directed inwards. The embossed areas in the two sidewalls are formed mirror-imagewise opposite one another at congruent locations, so 1 that an opening 13 defined between these embossed areas is in the shape of a rhombus as shown in FIG. 5. All of the embossed areas 11, 14 as shown in the figures have a length of 30 mm. The embossed areas 14 in FIGS. 4 and 5, although only indicated by respective lines, have a width of 0.5 mm with a spacing of 10 mm between adjacent embossed areas.

I claim:

1. A flexible bag made solely of a heat-sealable or weldable plastic sheet material and adapted to contain one of liquid and pastry products, said bag having two sidewall-forming parts comprising sheets sealingly connected to one another along their longitudinal margins and closed at the bottom, and defining a pouring spout including a dispensing opening at an upper end of said bag, wherein adjacent said dispensing opening two opposite portions of said sidewalls are each formed with at least one outwards projecting embossed area only partially extending along the longitudinal length of the sidewall, said embossed areas of said two sidewalls being disposed at congruent positions opposite one another and terminating at the edge of said dispensing opening.

2. A flexible bag according to claim 1, wherein said embossed areas extend substantially parallel to the sealed longitudinal margins of said sidewalls.

3. A flexible bag according to claim 1, wherein each of said embossed areas is formed with a length of 10 mm to 50 mm.

4. A flexible bag according to claim 1, wherein each of said embossed areas is shaped in the form of a channel.

5. A flexible bag according to claim 1, wherein the width of each embossed area is 5 mm to 10 mm.

6. A flexible bag according to claim 1, wherein each sidewall is formed with three embossed areas, the space between the opposite sidewalls defining said dispensing opening having the shape of a rhombus at the location of said embossed areas.

7. A flexible bag according to claim 6, wherein said embossed areas extend parallel to one another.

8. A flexible bag according to claim 6, wherein each of said embossed areas has a width of about 0.5 mm to 1 mm.

9. A flexible bag according to claim 1, wherein there are at least two adjacent embossed areas in each sidewall and said adjacent beads extend at a spacing of 5 mm to 10 mm from one another.

10. A flexible bag according to claim 1, wherein each sidewall is formed with one embossed area, said embossed areas cooperating to define a funnel.

11. A flexible bag according to claim 1, wherein the bag is formed as a stand-up bag having a foldable bottom portion incorporated between the lower transverse margins of said sidewalls so as to be capable of lying flat between said sidewalls.

12. A flexible bag according to claim 1, wherein an interior portion of one of said sheets is a polyethylene sheet.

13. A flexible bag according to claim 12, wherein said polyethylene sheet is a co-extrusion sheet.

14. A flexible bag according to claim 1, wherein said plastic sheet material is a twin-layer compound sheet.

15. A flexible bag according to claim 14, wherein an outwards directed portion of one of said sheets is a polyester sheet.

16. A flexible bag according to claim 14, wherein an outwards directed portion of said sheet has a thickness of at least 10 μm.

17. A flexible bag according to claim 16, wherein the outwards directed sheet has a thickness of 12 μm.

18. A flexible bag according to claim 14, wherein an inwards directed portion of said sheet has a thickness of 80 μm to 200 μm.

19. A flexible bag according to claim 18, wherein the inwards directed sheet has a thickness of 100 μm to 150 μm.

* * * * *

UNITED STATES PATENT AND TRADEMARK OFFICE

CERTIFICATE OF CORRECTION

PATENT NO. : 5,433,526

DATED : July 18, 1993

INVENTOR(S) : WILD

It is certified that error appears in the above-indentified patent and that said Letters Patent is hereby corrected as shown below:

On the title page, item [75] inventor, change "Ranier" should read --Rainer--.

Signed and Sealed this

Seventeenth Day of October, 1995

*Attest:*

BRUCE LEHMAN

*Attesting Officer*

*Commissioner of Patents and Trademarks*